United States Patent [19]

Ward

[11] 4,353,426

[45] Oct. 12, 1982

[54] PERCUSSIVE TOOLS

[75] Inventor: Richard Ward, Worsley, England

[73] Assignee: Dobson Park Industries Limited, England

[21] Appl. No.: 178,280

[22] Filed: Aug. 15, 1980

[30] Foreign Application Priority Data

Aug. 17, 1979 [GB] United Kingdom ..... 7928787

[51] Int. Cl.[3] ..... B25D 9/04

[52] U.S. Cl. ..... 173/119; 310/15

[58] Field of Search ..... 173/117, 118, 119, 124; 310/15, 152 (U.S. only)

[56] References Cited

U.S. PATENT DOCUMENTS

| | | | |
|---|---|---|---|
| 2,861,778 | 11/1958 | Spurlin | 173/119 X |
| 2,949,909 | 8/1960 | Macchioni et al. | 173/117 X |
| 3,132,268 | 5/1964 | Abel et al. | 310/15 |
| 3,792,740 | 2/1974 | Cooley | 173/119 |
| 3,878,412 | 4/1975 | Kurpanek | 173/117 X |

FOREIGN PATENT DOCUMENTS

| | | | |
|---|---|---|---|
| 1338796 | 8/1963 | France | 173/117 |
| 47-8878 | 3/1972 | Japan | 173/119 |
| 649791 | 5/1979 | U.S.S.R. | 173/117 |

*Primary Examiner*—Wm. Carter Reynolds
*Attorney, Agent, or Firm*—William A. Drucker

[57] ABSTRACT

A percussive tool, for use in mining, quarrying, or excavating, comprising a reciprocable mass movable in one direction against the resistance of a spring by a movable permanent magnet assembly. A hydraulic ram moves the permanent magnet assembly. A plate between the ram and the magnet assembly acts as a flux diverter such that as the assembly is moved proximate the plate by the ram, flux passing through the mass is reduced and the spring forces the mass to impact a tool shank.

15 Claims, 2 Drawing Figures

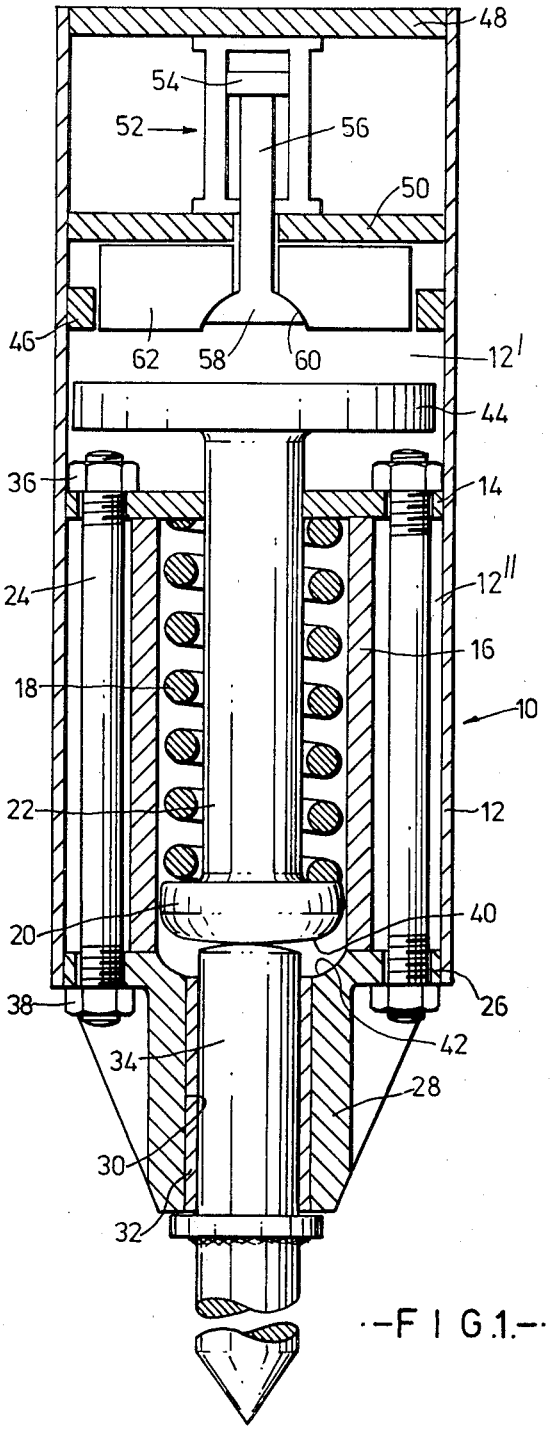
-FIG.1.-

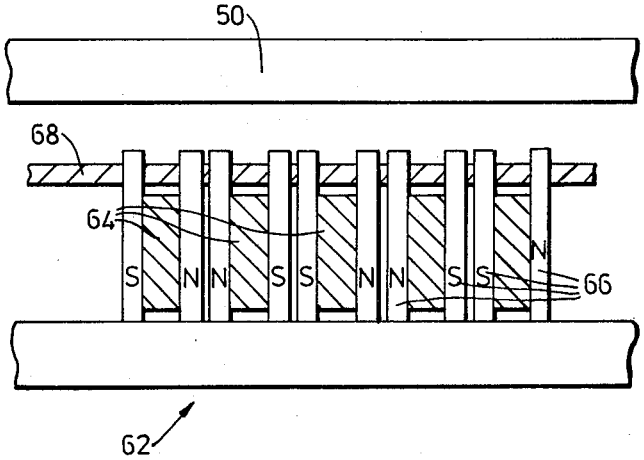
-FIG.2-

PERCUSSIVE TOOLS

DESCRIPTION

The invention relates to percussive tools and is applicable especially, but not exclusively, to percussive tools for use in mining, quarrying or excavating.

One particular application concerns percussive tools in which a reciprocable mass, conveniently referred to as a hammer piston, is retracted against a spring. When a desired spring loading has been achieved, the spring is released, driving the mass to impact against a tool, tool holder or intermediate member. The spring means may be a body of compressible fluid or a mechanical spring, for example a prestressed helical spring which is compressed by retraction of the hammer piston.

Conventionally, the hammer piston is retracted against the spring by mechanical means, or by pressurised hydraulic fluid, for example using a ram.

Releasing of the spring to initiate the impact or working stroke is often done by mechanical latch mechanisms. However, these mechanical latches are subject to wear, especially as a sudden release of the spring is required in order to make best use of its full compression. Such wear leads to unreliable operation and reduced life.

More sophisticated tools may have sensing means for initiating spring release in dependence upon hammer piston position or spring pressure, especially where the spring is a fluid. Unfortunately such sophisticated tools are rather expensive.

Thus, according to the present invention there is provided a percussive tool comprising a reciprocable mass movable in one direction against the resistance of spring means and in the opposite direction by the spring means to deliver an impact blow to a tool or intermediate holder therefor, retractor means for moving the mass in the aforesaid one direction, and magnetic coupling means serving to couple the retractor means to the mass during its movement thereof until a predetermined spring loading is attained, whereupon the coupling is released.

The magnetic coupling means may include a part of, or secured to, the retractor means, and a part of, or secured to, the mass.

The required excess of spring force over magnetic coupling force may be obtained simply by maintaining the magnetic coupling force substantially constant and increasing the spring force, by retraction of the mass, until it exceeds the magnetic force. Additionally or alternatively, the magnetic coupling force may be so reduced at the desired release position as to enable the spring force at that position to overcome much reduced net magnetic forces. For example, a simple abutment arrangement may be provided for the mass, and/or the magnetic circuit may be modified, say by contact with, or proximity to, a flux diverter means.

In a preferred embodiment, the retractor means includes a pressure-fluid-operated, preferably hydraulic, ram that acts to retract the mass or hammer piston and compress the spring or spring means. The magnetic coupling may include an annular magnet assembly on the retractor ram piston rod and a soft magnetic armature on the hammer piston rod, preferably at a position above a housing for the spring or spring means. Such an annular arrangement may afford a large magnetic coupling area. The armature and magnet assembly may be reversed between the rods, or magnet assemblies provided on both rods. The or each magnets assembly may comprise a permanent magnet.

The retractor will be controlled by suitable valve gear so that its piston will be periodically reciprocated to engage and retract, then release and re-engage the hammer piston. The only desired constraint is the obvious one that the re-engagement stroke does not start until the hammer piston drive stroke has begun.

One embodiment of the invention will now be specifically described, by way of example, with reference to the accompanying drawings, in which:

FIG. 1 is a diagrammatic longitudinal section through a percussive tool; and

FIG. 2 is a fragmentary section through a magnet assembly.

In FIG. 1 a percussive tool 10 comprises a generally cylindrical body 12 divided into upper and lower (as shown) chambers 12′ and 12″, respectively, by a fixed annular transverse divider 14. A cylindrical housing 16, for a prestressed compression spring 18, extends throughout the length of the lower chamber, coaxially with the body 12. The spring 18 acts between the divider 14 and a hammer piston 20 carried by a piston rod 22 which passes through, and is guided by, the divider 14. In the annular space exteriorly of the spring housing 16, but within the body 12, are circumferentially spaced tie bolts 24 which pass at one end through the divider 14 and at the other end through a flange 26 of a nose-piece 28 at the lower (as shown) end of the body 12. The nose-piece has a central bore 30 carrying a bearing sleeve 32 through which extends a tool shank 34. The tool shank 34 is slidingly retained in the bearing sleeve 32. Any convenient form of retention may be employed, such as pins on flats, or balls or rollers proud of the sleeve 32 and running in an upwardly terminated groove in the tool shank 34. The tie bolts 24 are shown with nuts 36 and 38, but obviously either may be a bolt head, preferably the upper 36 held captive on the divider 14. This tie-bolting ensures preloading of the spring 18.

It should be noted that crown 40 of the hammer piston 20 is domed and matches a well 42 formed in the nose-piece 28 and surrounding the inner end of the bore 30. The end of the tool shank 34 extends into the well 42 to such an extent that it can be struck by the hammer piston 20.

The end of the hammer piston rod 22 that projects into the upper chamber 12′ carries a head 44 slightly less in size than the interior cross-section of the body 12. The head 44 is of a soft magnetic material, such as iron. The maximum range of movement of the hammer piston 20 is limited at one end by engagement of its domed crown 40 in the well 42 and at the other end by engagement of the head 44 with an annular stop 46 fixed to the interior of the body 12. Circumferentially spaced stops may be substituted for the annular stop 46.

At its end opposite to the nose-piece 28, the body 12 is closed by a plate 48. A further annular divider plate 50 extends across the body 12 at a position spaced from both the plate 48 and annular stop 46. An hydraulic ram cylinder 52 is secured between the plate 48 and 50 and its piston 54 has a rod 56 extending through a central hole in the plate 50 and a corresponding hole in an annular permanent magnet assembly 62. At its free end the piston rod 56 has a self-aligning bearing part 58 configured to mate with a curved dishing 60 centrally of the annular permanent magnet assembly 62. The magnet assembly 62 could be free on the piston rod 56, but in the presently described embodiment is actually compliantly secured to the rod 56 and is also arranged to fit, with clearance, within the stop or stops 46.

In operation the hydraulic ram piston 54 will be reciprocated by pressurised fluid, at least for retraction. It should be appreciated that, where the tool is to be used in an upright position (as shown), the reverse stroke may be by gravity only, though that is not envisaged for the described embodiment for reasons that will become apparent.

At maximum extension of ram piston 54, the permanent magnet assembly 62 will couple to and engage the head 44 as an armature. Retraction of the ram piston 54 will then retract the hammer piston 20, compressing the spring 18, until one of the following occurs:

(a) the spring compression force exceeds the normal magnetic coupling force (b) the armature head 44 engages the mechanical stop or stops 46

(c) the permanent magnet assembly 62 has its magnetic forces reduced by proximity to the plate 50 where the latter is of magnetic material and acts as a flux diverter.

Other options will be discussed later herein but, on release of the magnetic coupling between armature 44 and magnet assembly 62, the hammer piston 20 will be driven by the spring 18 to deliver a blow to the tool shank 34 as desired.

Turning now to FIG. 2, a preferred permanent magnet assembly 62 is shown to comprise a plurality of permanent magnets 64, of high magnetic strength, associated with flanking flux concentrators 66.

Whilst parallel bands or an array of magnets and flux concentrators is assumed for the purpose of the drawing, annular magnets or/and flux concentrators could be employed. As shown, the magnets are secured to the flux concentrators, and the flux concentrators are fixed to a non-magnetic carrier plate 68 with the magnets on the side thereof facing the armature head 44 (not shown in FIG. 2). The flux concentrators extend through the plate 68 so as to be capable of coming into contact with, or closely adjacent to, the second divider plate 50, when the hammer piston is retracted, so that the divider plate 50 may divert flux as above-mentioned and thus weaken the magnetic coupling to the armature head 44. When the magnetic coupling force is exceeded by the spring compression force, the coupling is released and the spring 18 recoils, driving the hammer piston 20 to impact against the tool shank 34.

Then, of course, the hydraulic ram 54 must be extended again for its re-engagement stroke, i.e. to couple the magnet assembly to the head 44 again. There will be no problem over breaking the magnet assembly away from the diverter plate 50 as the full area of the ram piston 54 will receive hydraulic pressure, i.e. more than is available for the retraction stroke.

It is highly practical to utilise a combination of features wherein the magnetic coupling force must always at least slightly exceed the maximum spring force, the reduction of that magnetic coupling force by the flux diverter leaving but a very small net excess over the spring force. This net excess is then readily overcome by the ram as the armature contacts the abutments. Then, manufacturing tolerances may be of a minimum strictness consistent with high volume production.

It will be appreciated that the retraction ram could be replaced by some other form of reciprocating device, such as a cam-operated plunger or a motor-driven crank mechanism.

Also, of course, the permanent magnet assembly could be placed on the end of the hammer piston rod and the armature on the retractor, or magnet assemblies could be provided on both.

Also, an electric coil could be used to weaken, or to cause or enhance diversion of, or even opposition to, the magnetic coupling flux for release purposes.

It will be appreciated that suitable magnetic diverters might be movable axially of the tool in order to adjust tool power or stroke and/or might be associated with electrical coil means to vary the diverters effect.

I claim:

1. A percussive tool comprising:

(i) a tool body (ii) an impacting mass reciprocable with respect to said tool body in first and second opposed directions (iii) spring means positioned to act between said body and said mass to drive said mass in said second direction for delivering impact to a tool, (iv) retractor means positioned to act between said body and said mass, to drive said mass in said first direction, (v) magnetic coupling means for coupling said retractor means to said mass during movement in said first direction until a predetermined loading of said spring means is attained whereupon said coupling is released, said magnetic coupling means including a first part on said retractor means and a second part on said mass, at least one of said parts including a permanent magnet, and a magnetic flux diverter into operative proximity with which said permanent magnet is moved upon attainment of said predetermined loading.

2. A percussive tool, as claimed in claim 1, wherein said permanent magnet is secured to said retractor means.

3. A percussive tool, as claimd in claim 1 wherein said permanent magnet includes flux concentrator members.

4. A percussive tool, as claimed in claim 3, wherein said flux concentrator members protrude towards said magnetic flux diverter.

5. A percussive tool, as claimed in claim 1, comprising an abutment for limiting movement of said mass in said first direction to an extent corresponding to said predetermined loading.

6. A percussive tool, as claimed in claim 1, wherein said tool body has first and second chambers, said magnetic coupling means being in said first chamber, and said spring means being in said second chamber.

7. A percussive tool, as claimed in claim 6, comprising a divider in said tool body between said first and second chambers, said spring means comprising a prestressed helical spring, said helical spring bearing on said divider serving as a thrust seat therefor, said helical spring also bearing on said mass.

8. A percussive tool, as claimed in claim 7, wherein said mass includes a hammer piston carried by a piston rod, said piston rod extending through said divider, and said helical spring bearing on said hammer piston.

9. A percussive tool, as claimed in claim 6, wherein said retractor means includes a retractor drive mechanism, and wherein said tool body includes means dividing said first chamber from said retractor drive mechanism.

10. A percussive tool, as claimed in claim 9, wherein said retractor drive mechanism is a pressure-fluid operable ram.

11. A percussive tool, as claimed in claim 10, wherein said ram is hydraulic.

12. A percussive tool, as claimed in claim 9, wherein said means dividing said first chamber from said retractor drive mechanism is a plate comprised in said magnetic flux diverter.

13. A percussive tool, as claimed in claim 6, comprising a divider in said tool body between said first and second chamber, a tool holding nose piece on said tool body, and tie bolting acting between said divider and said nose piece to secure said nose piece on said body.

14. A percussive tool, as claimed in claim 13, comprising a housing in said tool body for said spring means, said housing and said tool body bounding an annular space between them, said tie bolting being disposed in said annular space.

15. A percussive tool, as claimed in claim 1, comprising a self-aligning coupling between said permanent magnet and said at least one part.

* * * * *